US009629404B2

(12) United States Patent
Rutledge et al.

(10) Patent No.: US 9,629,404 B2
(45) Date of Patent: Apr. 25, 2017

(54) DEVICE AND METHOD FOR PROTECTING CLOTHING

(71) Applicant: Underbelly, LLC, San Diego, CA (US)

(72) Inventors: Mary Rutledge, San Diego, CA (US); Katheryn Haro, San Diego, CA (US)

(73) Assignee: Underbelly, LLC, San Diego, CA (US)

( * ) Notice: Subject to any disclaimer, the term of this patent is extended or adjusted under 35 U.S.C. 154(b) by 0 days.

(21) Appl. No.: 15/003,087

(22) Filed: Jan. 21, 2016

(65) Prior Publication Data

US 2016/0135526 A1 May 19, 2016

Related U.S. Application Data

(63) Continuation of application No. 14/708,201, filed on May 9, 2015, now abandoned.

(60) Provisional application No. 61/991,268, filed on May 9, 2014.

(51) Int. Cl.
*A41D 27/12* (2006.01)

(52) U.S. Cl.
CPC ..... *A41D 27/12* (2013.01)

(58) Field of Classification Search
CPC ..... A41D 27/12; Y10T 24/149; Y10T 24/14; Y10T 24/157; Y10T 24/1492; A45D 2/18
USPC ..... 2/46; 224/667, 662, 660
See application file for complete search history.

(56) References Cited

U.S. PATENT DOCUMENTS

| | | | | |
|---|---|---|---|---|
| 2,542,601 | A * | 2/1951 | Van Cleef | A45D 2/18 132/246 |
| 5,054,299 | A * | 10/1991 | Maveety | A44C 5/0023 63/11 |
| 5,498,190 | A * | 3/1996 | Ganson | A63H 33/04 446/107 |
| 8,387,216 | B1 * | 3/2013 | Martinson | B65D 63/10 24/16 PB |
| 2007/0028367 | A1 * | 2/2007 | Allen | A41D 27/12 2/244 |
| 2012/0198680 | A1 * | 8/2012 | Durben | A47G 25/08 29/428 |
| 2014/0026283 | A1 * | 1/2014 | Hayes | A41B 13/00 2/46 |

* cited by examiner

*Primary Examiner* — Robert J Sandy
*Assistant Examiner* — Michael Lee
(74) *Attorney, Agent, or Firm* — Kevin Keener; Keener and Associates, P.C.

(57) ABSTRACT

The clip has a core and a sleeve. The sleeve encases the core. The clip is substantially rectangular in shape and has a first end and a second end. The clip is bendable into a shaped configuration. In the shaped configuration the first end of the clip is positioned next to the second end of the clip, the first end of the clip being substantially parallel to the second end of the clip, the first end of the clip and the second end of the clip defining an internal space between the first end of the clip and the second end of the clip. The clip is placed over the waist band of a user's pants to prevent portions of the waist band from rubbing on the underside of a user's shirt.

6 Claims, 11 Drawing Sheets

DEVICE AND METHOD FOR PROTECTING CLOTHING

This application is a continuation of and claims priority to U.S. patent application Ser. No. 14/708,201 filed on May 9, 2015, which claims priority to U.S. provisional patent application Ser. No. 61/991,268 filed on May 9, 2015.

FIELD OF INVENTION

This invention pertains generally to clothing accessories and more particularly to a malleable device and method for protecting clothing.

BACKGROUND OF INVENTION

T-shirts have become a staple product in all wardrobes for men and women. T-shirts are as diverse as the millions who wear them and prices and fabrics vary. Some shirts are sold for upwards of $500.00. Fabric used for t-shirts range from modal, blends of rayon/cotton/polyester and cotton. These fabrics are used because they have a sensual feel. Some t-shirts brands (especially high-end) have mastered the very thin, light weight, soft and comfortable fabric t-shirt that has become an imported item in high-fashion brand collections.

The most popular type of pants to wear are denim jeans. In contrast to the soft materials utilized for shirts, denim is a stiff and coarse material. Jeans normally have a pair of flaps surrounding the zipper with a button or a snap placed at top. Through movement and bending over, the corner of the front flap of the jeans bends outward. Because the most popular dress attire is the combination of t-shirt and jeans, the stiff, hardened corner of the jeans frequently comes into contact with the inside of the soft t-shirt. Over time, the continuous rubbing and movement of the corner of the jeans wears away the fabric of the t-shirt, causing a hole to appear in the lower front of the t-shirt. What is needed is a method and device to protect the t-shirt from the abrasion caused by the waistband of jeans at the button closure area.

SUMMARY OF INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

A clip for adhering to clothing comprising a core and a sleeve. The core is an elongated rectangular body having a first end and a second end. The sleeve encases the core. The sleeve is composed of a soft and pliable material. The clip is substantially rectangular in shape and has a first end and a second end. The clip is bendable into a shaped configuration. In the shaped configuration the first end of the clip is positioned next to the second end of the clip, the first end of the clip being substantially parallel to the second end of the clip, the first end of the clip and the second end of the clip defining an internal space between the first end of the clip and the second end of the clip.

The core may be composed of a metal. The metal for the core is chosen from a group consisting essentially of: aluminum, steel, copper, nickel, gold, spring steel, tin, iron, silver, and zinc. The sleeve may be composed of a material chosen from the group consisting essentially of: leather, rubber, synthetic rubber, sponge, synthetic sponge, silicone, polymer, and elastomer.

In another embodiment of the invention the core further comprises one or more core joints, the one or more core joints extending the width of the core, the one or more core joints being substantially perpendicular to the longitudinal axis of the core.

In another embodiment of the invention the sleeve further comprises one or more sleeve joints, the one or more sleeve joints extending the width of the sleeve and the one or more sleeve joints being substantially perpendicular to the longitudinal axis of the sleeve. In another embodiment of the invention the sleeve further comprises a textured region. The textured region may further comprise a tactile adhesive.

In another embodiment of the invention the core further comprises a first magnetized region and a second magnetized region. The first magnetized region is disposed toward the first end of the core. The second magnetized region is disposed toward the second end of the core. The first magnetized region is configured to exert an attractive force on the second magnetized region when the clip is bent into the shaped configuration.

In another embodiment of the invention the sleeve consists of two sleeve sections, the first sleeve section encasing the first end of the core, the second sleeve section encasing the second end of the core. In another embodiment of the invention the shaped configuration the clip is shaped to consist of a front member measuring 1.5 inches wide by 1.5 inches long, a rear member measuring 1.5 inches wide by 2 inches long, and an upper connector measuring 1.5 inches wide by ⅜ inches deep from the outer point of the front member to the outer point of the rear member and ¼ inches deep from the inner point of the front member to the inner point of the rear member.

The invention is also directed toward method of preventing a section of the waist band of pants from rubbing against a shirt. The method comprises utilizing a clip in a first configuration, bending the clip into a second configuration, placing the clip over the waist band of a pair of pants, compressing the front member toward the rear member, and compressing the waist band of a pair of pants within the internal space between the front member and the rear member. The clip comprises a core and a sleeve. The sleeve encases the core. The sleeve is a soft and pliable material. The core is an elongate body having a first end and a second end. The clip is substantially rectangular in shape and has a first end and a second end. In the second configuration the first end of the clip is positioned next to the second end of the clip. The first end of the clip is substantially parallel to the second end of the clip and the first end of the clip and the second end of the clip define an internal space between the first end of the clip and the second end of the clip. When placed over the waist band of the pair of pants the first end of the clip is disposed between the waist band of a pair of pants and the shirt worn by the user, the second end of the clip is disposed between the waist band of a pair of pants and the user, and the waist band of the pair of pants is disposed within the internal space between the first end of the clip and the second end of the clip.

The method may further comprise lifting the first end of the clip away from the second end of the clip and removing the clip from the waist band of a pair of pants.

In another embodiment of the method the sleeve of the clip further comprises a textured area. In this embodiment the method further comprises ensuring the textured area is disposed within the internal space between the front member and the rear member when the clip is in the second configuration.

In another embodiment of the method the core of the clip further comprises a first magnetized area disposed toward the first end of the core and a second magnetized area disposed toward the second end of the core with the first magnetized region being configured to exert an attractive force on the second magnetized region when the clip is bent into the second configuration. In this embodiment the method further comprises ensuring the first magnetized area is disposed adjacent to the second magnetized area when the clip is bent into the second configuration.

As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

Figure 1:
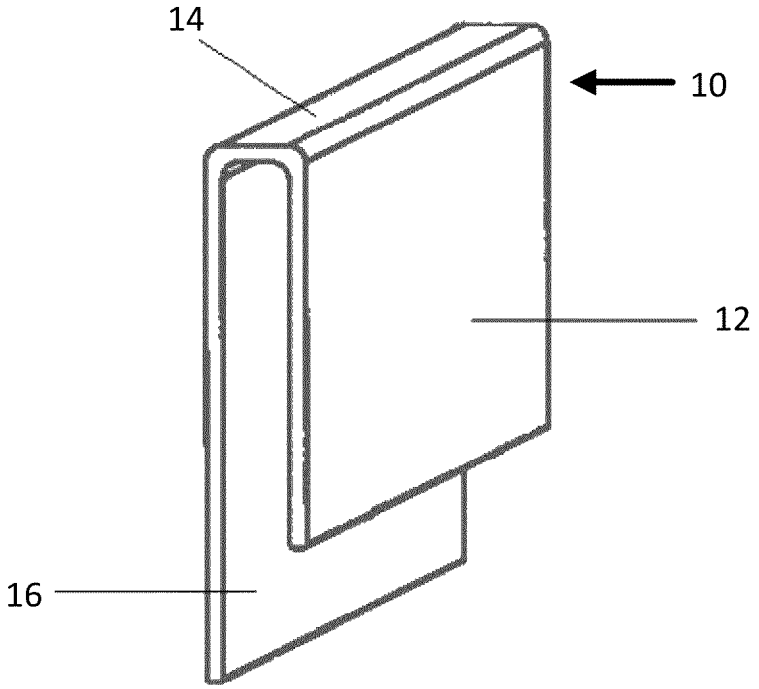
FIG. 1 is a perspective view of the clip.

The invention is directed toward a clip for placing over the front button flap of a user's jeans to prevent the corner of the flap from wearing on a shirt worn by the user. Referring to FIG. 1, the clip 10 is displayed. The clip 10, when worn by the user, has a front member 12 and a rear member 16 connected by an upper connector 14. When worn by a user, the front member 12 is positioned on top of the button flap of the jeans. The upper connector 14 extends over the top edge of the button flap of the jeans and the rear member 16 extends behind the button flap of the jeans. The button flaps of the jeans are positioned in the space between the rear member 16 and front member 12 when worn by the user. When worn, the front member 12 is positioned between the button flap of the jeans and the user's t-shirt. The front member 12 holds down the button flap and prevents the button flap of the jeans from rubbing on the t-shirt and causing wear.

The clip 10 is a thin elongated rectangular body. The clip 10 is malleable and bendable so that a user can angle and position the clip 10 in any desirable position. The user can also bend and angle the rear member 16 and front member 12 into any shape and position. The rear member 16 and front member 12 may be positioned relative to each other in any manner so that the upper connector 14 can be any length. The upper connector 14 may be positioned short in length so that the space between the rear member 16 and front member 12 is small and the clip 10 is tightly compressed onto the button flaps of the jeans. Alternatively the upper connector 14 may be positioned longer in length so that the space between the rear member 16 and front member 12 is greater and the clip 10 is loosely compressed onto the button flaps of the jeans.

Figure 2:
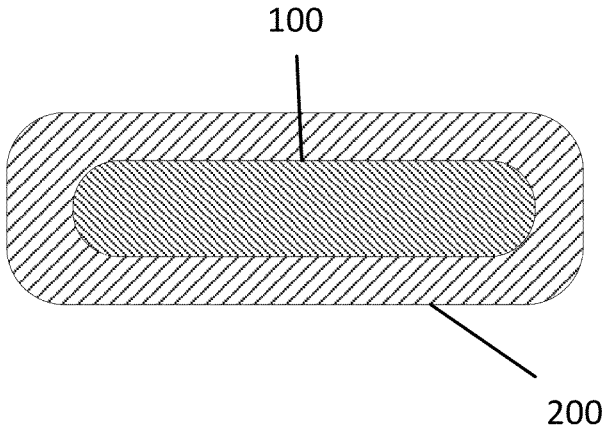
FIG. 2 is a cross sectional view of the clip.

Referring to FIG. 2, a cross section of the clip 10 is displayed. The clip comprises a core 100 and a sleeve 200. The core 100 is a thin elongate rectangular member. The core 100 may be made of any material. In the preferred embodiment the core 100 is composed of a malleable metal, such as aluminum, steel, copper, nickel, gold, spring steel, tin, iron, silver, zinc, or any other commercially available metal. The sleeve 200 is an elongate rectangular member with an internal cavity for holding the core 100. The sleeve 200 is composed of a soft and pliable material. Any type of material may be used for the sleeve 200. The sleeve 200 may be composed of leather, silicone, synthetic rubber, sponge, polymer, elastomer, or any other commercially available material.

Figure 3A:
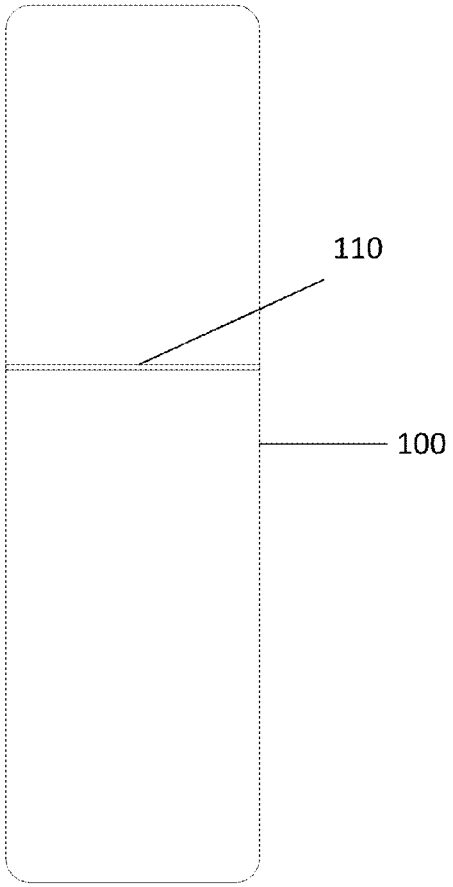
FIG. 3A is a top view of the core.
Figure 3B:
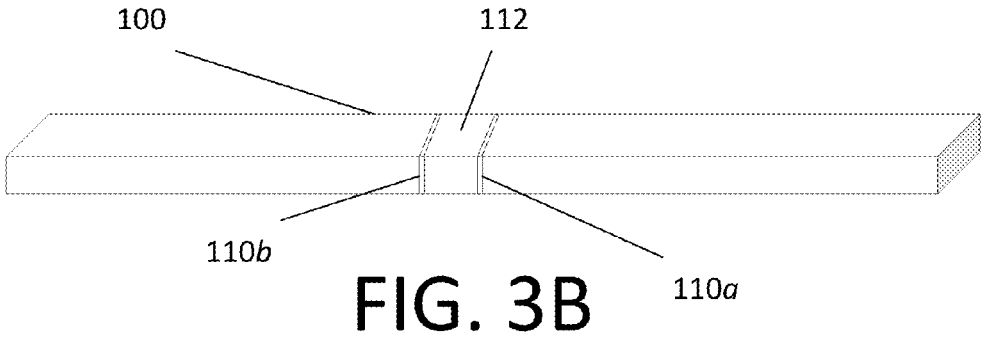
FIG. 3B is a perspective view of the core.

Referring to FIG. 3A, the core 100 is displayed. When not in use the core 100 is an elongated rectangular member. Positioned approximately midway along the length of the core is a core joint 110. The core joint 110 extends along the width of the core 100 and substantially traverses the length of the core 100. The core joint 110 provides a point of flexibility such that the core 100 can be folded so that one end of the core 100 is disposed within the front member 12 and the opposite end of the core 100 is disposed within the rear member 16. The core joint 110 is disposed within the upper connector 14 when the core 100 is folded and in use. The core 100 may have one core joint 110 as displayed in FIG. 3A or may have two core joints 110*a*, 110*b* as illustrated in FIG. 3B. Between the first core joint 110*a* and the second core joint 110*b* is the upper core connector 112. The upper core connector 112 is disposed in the upper connector 14 when the clip 10 is in use. Each of the core joints 110*a*, 110*b* may be formed by a groove in the surface of the core 100. Alternatively, each of the core joints 110*a*, 110*b* may be formed by a depression or thinning of the thickness of the core 100. Alternatively, each of the core joints 110*a*, 110*b* may be formed by a hinge.

Figure 4A:
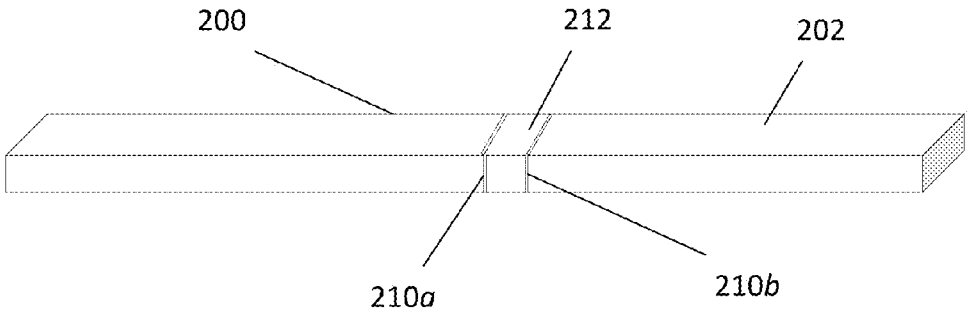
FIG. 4A is a perspective view of the sleeve.
Figure 4B:
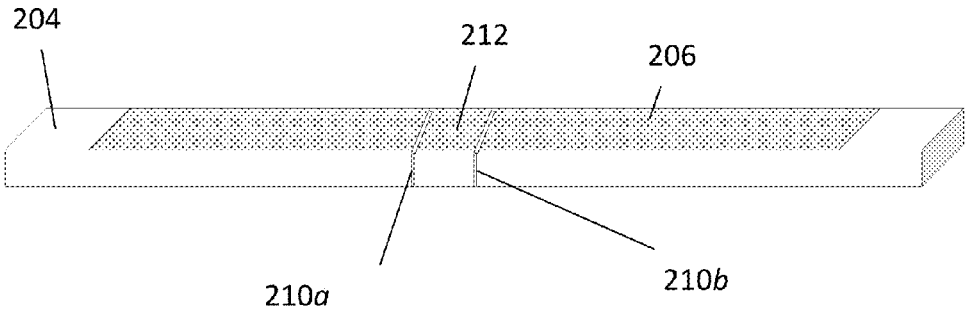
FIG. 4B is a perspective view of the sleeve.

Referring to FIG. 4A and FIG. 4B the preferred embodiment of the sleeve 200 is displayed. The sleeve 200 has a sleeve back 202 and a sleeve front 204. The sleeve 200 has a first sleeve joint 210*a* and a second sleeve joint 210*b*. Positioned between the first sleeve joint 210*a* and a second sleeve joint 210*b* is the upper sleeve connector 212. The upper sleeve connector 212 is disposed in the upper connector 14 when the clip 10 is in use. The first sleeve joint 210*a* and a second sleeve joint 210*b* are respectively disposed adjacent to the first core joint 110*a* and the second core joint 110*b*. The upper sleeve connector 212 is disposed adjacent to the upper core connector 112. The sleeve joints

210*a*, 210*b* extend along the width of the sleeve 200 and substantially traverses the length of the sleeve 200. The sleeve joints 210*a*, 210*b* provide points of flexibility such that the sleeve 200 can be folded so that one end of the sleeve 200 is disposed within the front member 12 and the opposite end of the sleeve 200 is disposed within the rear member 16.

Positioned on the sleeve front 204 is a textured region 206. The textured region 206 is an area on the sleeve front 204 that provides an enhanced frictional surface to ensure the adhesion to the clip 10 to the button flaps of the jeans. The textured region 206 may be any size and shape. The textured region 206 may be formed by a dimpling in the material composing the sleeve 200. Alternatively, the textured region 206 may be an additional pad of material adhered to the sleeve front 204. The textured region 206 may be formed by a rigid polymer or rough type fabric. Alternatively, the textured region 206 may be a smooth area further comprising a tactile adhesive to removably secure the clip 10 to the button flap of the user's jeans.

Figure 5:
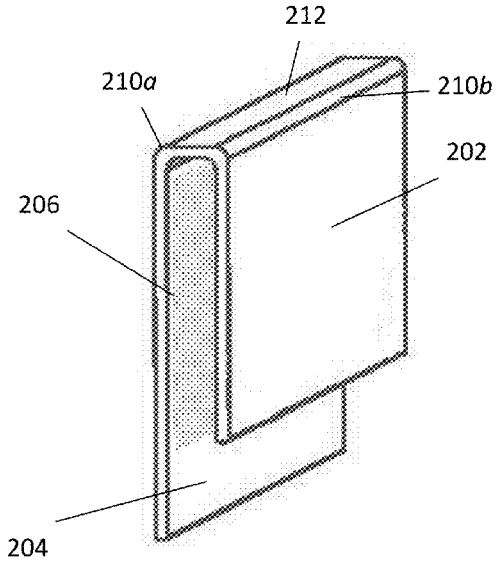
FIG. 5 is a perspective view of the sleeve.

Referring to FIG. 5 the sleeve 200 is displayed in a folded configuration as when it is in use. The sleeve back 202 is disposed on the external areas of the clip 10. The sleeve front 204 is disposed on the areas of the clip 10 adjacent to the button flaps of the user's jeans. The textured region 206 is disposed on areas of the front member 12 and rear member 16 adjacent to the button flaps of the user's jeans. The first sleeve joint 210*a* and second sleeve joint 210*b* are positioned on the outer edges of the upper connector 14. The upper sleeve connector 212 is coextensive with the upper connector 14. The first sleeve joint 210*a* is located at the joint between the upper connector 14 and rear member 16. The second sleeve joint 210*b* is located at the joint between the upper connector 14 and rear front member 12.

Figure 6:
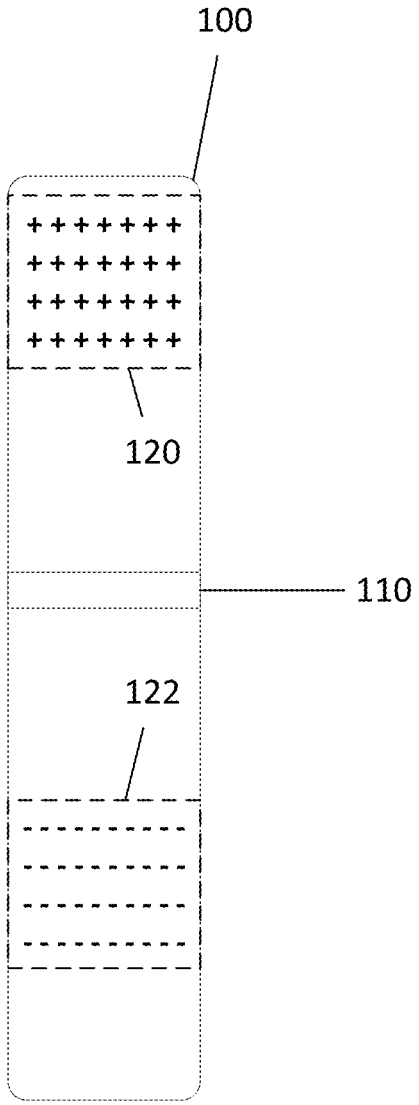
FIG. 6 is a top view of an alternative embodiment of the core.

Referring to FIG. 6, an alternative embodiment of the core is displayed. In the alternative embodiment the core 100 further comprises a first magnetized area 120 and a second magnetized area 122. The first magnetized area 120 is disposed on one end of the core 100 and the second magnetized area 122 is disposed on the opposite end of the core 100 and are separated by the core joint 110. The first magnetized area 120 has a magnetic charge opposite from the magnetic charge of the second magnetized area 122. The first magnetized area 120 exerts an attractive force on the second magnetized area 122 through the button flaps of the jeans when the clip 10 is folded and being used. In this manner the first magnetized area 120 is disposed in the front member 12 and the second magnetized area is disposed in the rear member 16. The attractive force between the first magnetized area 120 and the second magnetized area 122 draw the front member 12 and rear member 16 closer together, increasing the frictional hold of the clip 10 on the button flaps of the jeans and preventing the accidental removal of the clip 10.

Figure 7:
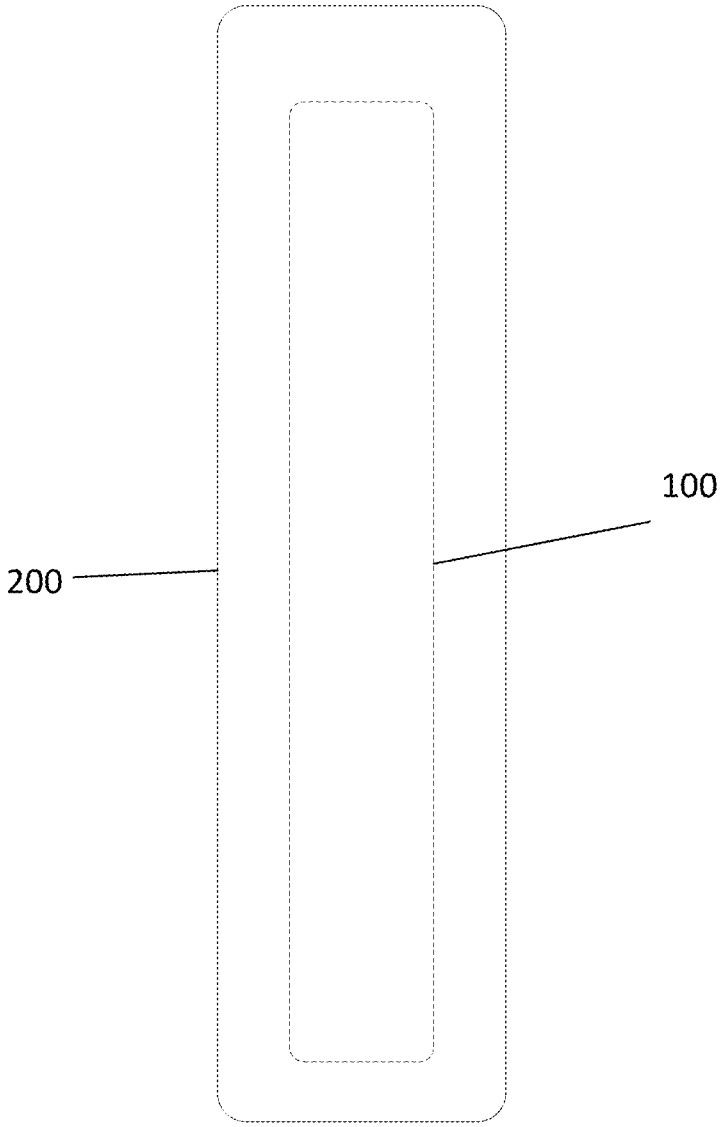
FIG. 7 is a top view of the clip in a straightened configuration.
Figure 8:
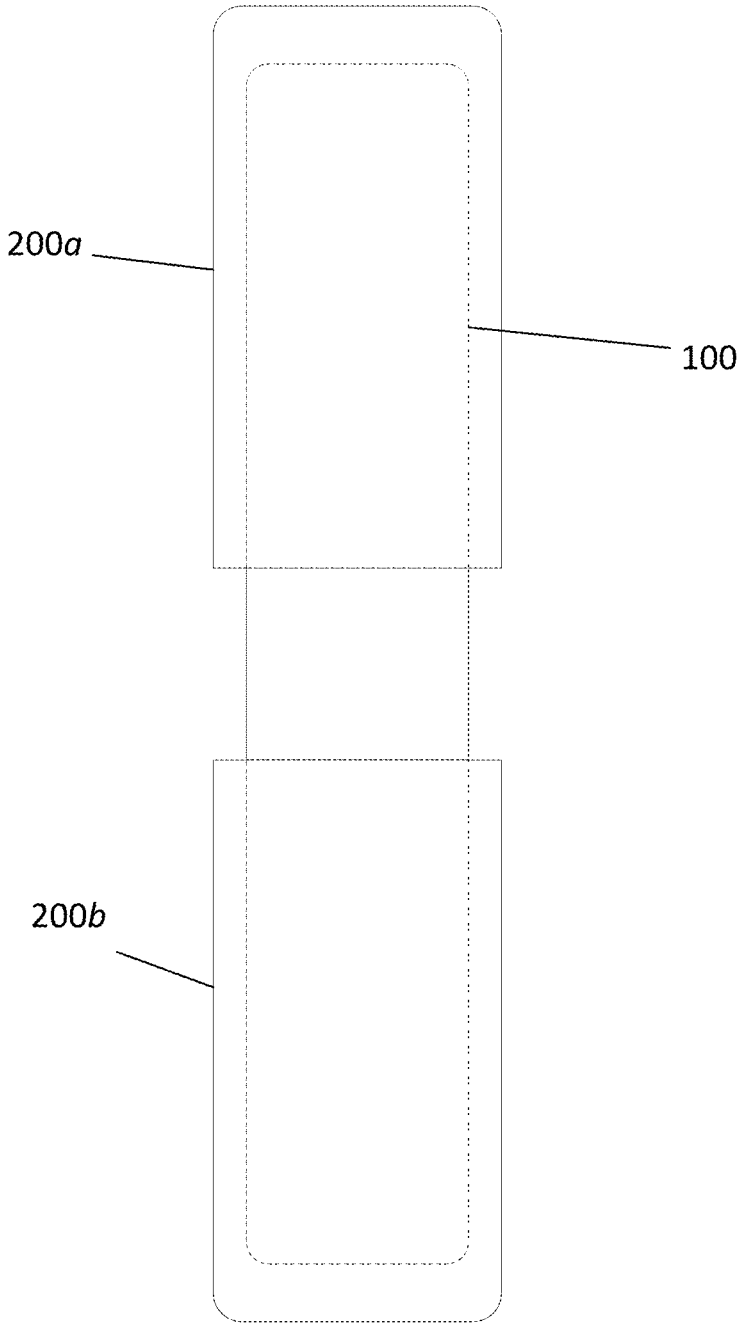
FIG. 8 is a top view of an alternative embodiment of the clip in a straightened configuration.

Alternative embodiments of the clip 10 are possible. As illustrated in FIG. 7, the core 100 may be fully encompassed by the sleeve 200. Alternatively, as illustrated in FIG. 8, the core 100 may be encompassed on one end by a first sleeve section 200*a* and the other end of the core 100 may be encompassed by a second sleeve section 200*b*. In this embodiment the front member 12 is encased in the first sleeve section 200*a* and the rear member 16 is encased in the second sleeve section 200*b*. In this embodiment the upper connector 14 is composed solely of the core 100.

Figure 9:
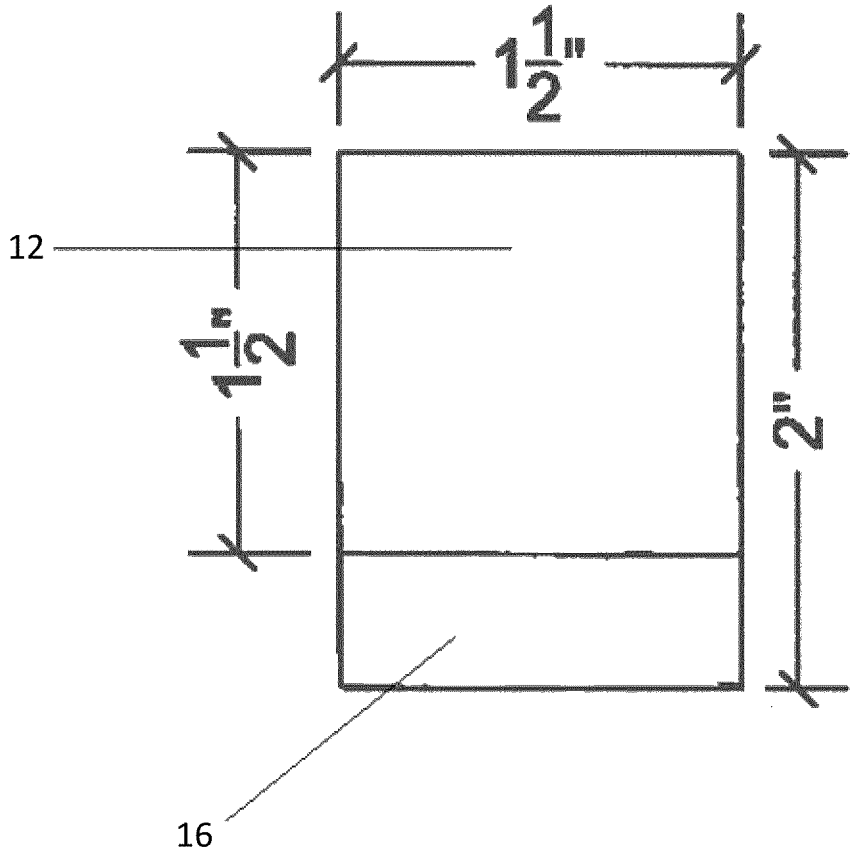
FIG. 9 is a front view of the clip.
Figure 10:
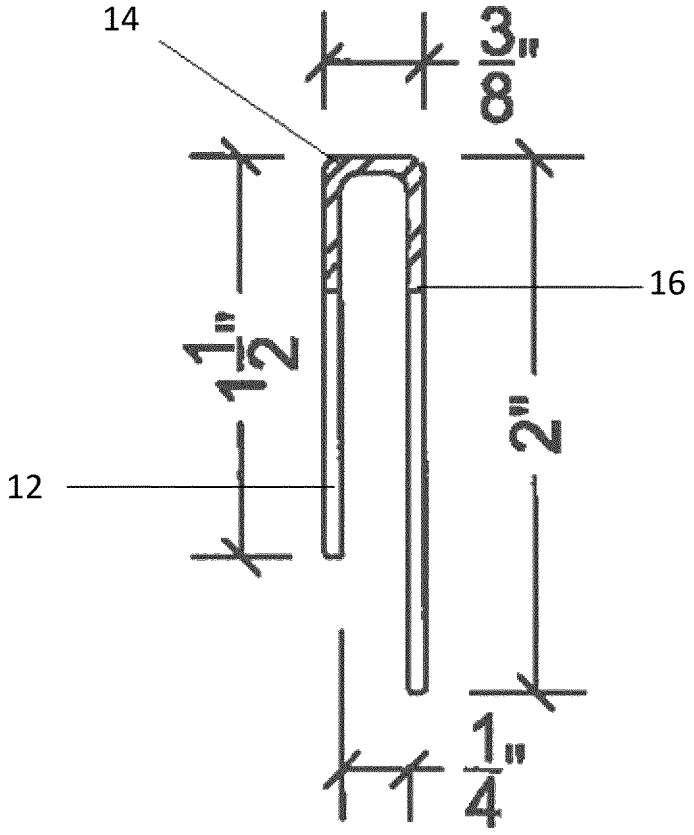
FIG. 10 is a side view of the clip.

The clip 10 may be configured to be any size and shape. The front member 12, upper connector 14, and rear member 16 may each be any size and shape. Referring to FIG. 9 and FIG. 10 the preferred dimensions of the clip 10 are displayed. In the preferred embodiment the front member 12 is 1.5 inches wide and 1.5 inches long. The rear member 16 is 1.5 inches wide 2 inches long. The outer width of the upper connector 14 is ⅜ inches. The internal width of the upper connector 14 is ¼ inches. The thickness of the clip 10 is 1/16 inches.

Figure 11:
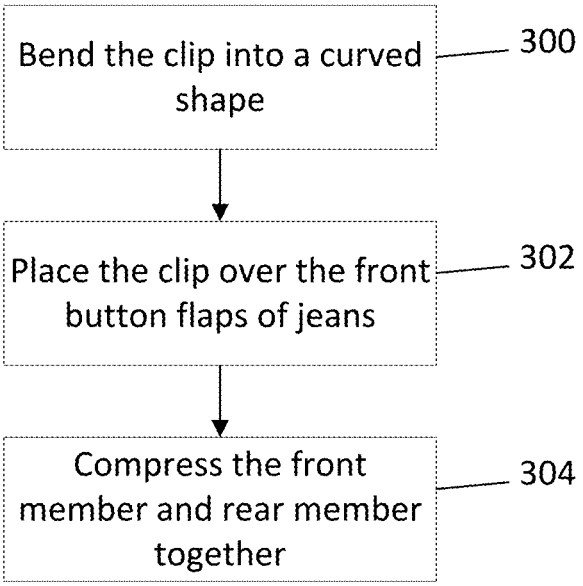
FIG. 11 is a schematic describing the use of the clip.

Referring to FIG. 11 the method of utilizing the clip 10 is illustrated. First the user bends the clip into a curved shape 300. Shaping the clip 10 into the curved structure substantially forms the front member 12, upper connector 14, and rear member 16. The user places the clip over the button flaps of the jeans 302. The user then compresses the front member 12 and rear member 14 together to adhere the clip to the button flaps of the jeans 304.

Still other embodiments and methods of protecting clothing from rigid button flaps of jeans are conceivable. In one embodiment, the button flaps of the jeans are coated in a rigid material preventing distortion of the button flaps. For instance the button flaps may be dipped in a liquid polymer or elastomer which then dries and hardens into a stiff and unflexible sleeve. In other embodiments the clip can be sewn or otherwise adhered onto one of the two button flaps. The second button flap then fits within the internal space when the user buttons their pants. The user can then compress the front member and rear member together onto the two button flaps.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. A method of preventing a section of the waist band of pants from rubbing against a shirt comprising a) utilizing a clip in a first configuration i) said clip comprising (1) a core, said core being an elongate body having a first end and a second end;

(2) one or more sleeve portions, wherein each of said one or more sleeve portions encase at least a portion of said core, each of said one or more sleeve portions being a soft and pliable material;

ii) wherein said clip is substantially rectangular in shape having a first end and a second end;

b) bending said clip into a second configuration i) wherein in said second configuration said first end of said clip is positioned next to said second end of said clip, said first end of said clip being substantially parallel to said second end of said clip, said first end of said clip and said second end of said clip defining an internal space between said first end of said clip and said second end of said clip;

c) placing said clip over the waist band of a pair of pants i) said first end of said clip being disposed between said waist band of a pair of pants and the shirt worn by the user;

ii) said second end of said clip being disposed between said waist band of a pair of pants and the user;

iii) said waist band of said pair of pants being disposed within said internal space between said first end of said clip and said second end of said clip;

d) compressing said front member toward said rear member;

e) compressing said waist band of a pair of pants within said internal space between said front member and said rear member.

2. The method as in claim 1 further comprising a) lifting the first end of said clip away from said second end of said clip;

b) removing said clip from said waist band of a pair of pants.

3. The method as in claim 2 a) wherein said one or more sleeve portions of said clip further comprises a textured area;

b) said method further comprising i) ensuring said textured area is disposed within said internal space between said front member and said rear member when said clip is in said second configuration.

4. The method as in claim 3 a) wherein said core of said clip further comprises a first magnetized area disposed toward said first end of said core and a second magnetized area disposed toward said second end of said core, said first magnetized region being configured to exert an attractive force on said second magnetized region when said clip is bent into said second configuration;

b) the method further comprising i) ensuring said first magnetized area is disposed adjacent to said second magnetized area when said clip is bent into said second configuration.

5. The method as in claim 1 a) wherein said one or more sleeve portions of said clip further comprises a textured area;

b) said method further comprising i) ensuring said textured area is disposed within said internal space between said front member and said rear member when said clip is in said second configuration.

6. The method as in claim 1 a) wherein said core of said clip further comprises a first magnetized area disposed toward said first end of said core and a second magnetized area disposed toward said second end of said core, said first magnetized region being configured to exert an attractive force on said second magnetized region when said clip is bent into said second configuration;

b) the method further comprising i) ensuring said first magnetized area is disposed adjacent to said second magnetized area when said clip is bent into said second configuration.

* * * * *